United States Patent [19]

Hoch et al.

[11] Patent Number: 4,716,808

[45] Date of Patent: Jan. 5, 1988

[54] MECHANICAL LAUNCH SEQUENCER FOR A MISSILE

[75] Inventors: Robert L. Hoch, Merritt Island; James J. Kessler, Titusville; Thomas J. Long, Maitland, all of Fla.

[73] Assignee: McDonnell Douglas Corporation, Long Beach, Calif.

[21] Appl. No.: 797,226

[22] Filed: Nov. 12, 1985

[51] Int. Cl.[4] ..... F41F 3/052

[52] U.S. Cl. ..... 89/1.812; 89/1.807

[58] Field of Search ..... 89/1.812, 1.806, 1.807, 89/27.3; 102/258, 259, 260, 261, 223, 229, 224

[56] References Cited

U.S. PATENT DOCUMENTS

| | | | |
|---|---|---|---|
| 2,788,712 | 4/1957 | Kuller et al. | 89/1.807 |
| 3,374,709 | 3/1968 | Campbell et al. | 102/223 |
| 3,721,155 | 3/1973 | Stauff et al. | 89/1.807 |
| 3,960,051 | 6/1976 | Hunt | 89/1.812 |
| 3,983,785 | 10/1976 | Dissmeyer et al. | 89/1.819 |

FOREIGN PATENT DOCUMENTS

| | | | |
|---|---|---|---|
| 41907 | 7/1919 | United Kingdom | 89/27.3 |

*Primary Examiner*—Stephen C. Bentley
*Assistant Examiner*—Stephen Johnson
*Attorney, Agent, or Firm*—James M. Skorich; George W. Finch; John P. Scholl

[57] ABSTRACT

Apparatus for sequencing the release of a missile from its launch apparatus, the unlocking of the missile's warhead fuze pre-launch safety lock, and the ignition of the missile's rocket motor. A cylindrical block having a radial passageway is situated between the warhead and the rocket motor of a missile. An actuator piston having a hollow cylindrical core slides within the passageway. One end of the actuator piston projects from the passageway and is engaged with the launch apparatus to prevent movement of the missile relative to the launch apparatus prior to launch. A source of pressurized gas communicates with the hollow core of the actuator piston through an opening in the actuator piston's projecting end. A notch in the side of the actuator piston is engaged with the warhead fuze pre-launch safety lock. The introduction of the pressurized gas into the actuator piston drives it into the passageway and results in the withdrawal of the projecting end of the actuator piston from its engagement with the launch apparatus, while simultaneously forcing the engaged notch to unlock the warhead fuze pre-launch safety lock. The actuator piston continues to travel into the passageway until a port in the side of the actuator piston communicates with an adjacent ignition piston chamber. The flow of pressurized gas from the hollow core of the actuator piston into the ignition piston chamber forces an ignition piston located therein to strike and ignite an ignition primer, ultimately resulting in the ignition of the rocket motor.

15 Claims, 6 Drawing Figures

MECHANICAL LAUNCH SEQUENCER FOR A MISSILE

BACKGROUND OF THE INVENTION

1. Field of the Invention

This invention pertains to apparatus for sequencing events typically necessary to launch a missile and, more particularly, to accomplishing this sequencing mechanically, that is, without using electrical components.

2. Description of the Prior Art

Missiles launched from tubes or rails are rigidly attached to such launch apparatus to facilitate transport and handling prior to launch. One type of attachment device presently used requires manual removal whenever launch of the missile is anticipated. To avoid delay in a combat situation, this device can be removed when the missile reaches its launch area, although employing this procedure predisposes the missile to accidents from mishandling prior to launch.

Another commonly used attachment device employs pins which shear upon being subjected to the axial force generated by the thrust of the missile's rocket motor during launch. Although shear pins obviate the need for the manual removal of attachment apparatus prior to launch, they create launch debris and the hazards attendant thereto. When the launch apparatus is held on the shoulder of the operator, the use of shear pins causes reaction forces to be transmitted to the operator, that is, the launch apparatus pulls the operator towards the target, which makes it difficult for the operator to keep the aiming sight positioned on the target.

As a further concession to safety, the warhead fuzes in the current generation of missiles employ two safety locks, the engagement of either of which prevents the warhead fuze from becoming armed. One is a mechanical locking mechanism which is unlocked by the inertial force produced by the axial acceleration occurring during the launch of the missile. The second fuze safety lock is not sensitive to axial acceleration, and is required to be unlocked prior to the launch of the missile. The use of this second safety device is intended to prevent a missile that has been accidentally launched from becoming armed. Such pre-launch safety locks are presently unlocked by an electro-explosive device that is actuated by an electrical signal.

An electrically actuated pyrotechnic device is currently used to ignite the rocket motor milliseconds after the release of the pre-launch safety lock.

Problems with the use of electrical devices to unlock the fuze pre-launch safety lock and ignite the rocket motor arise from their vulnerability to electromagnetic interference as well as degradation from aging and voltage reductions occasioned by low temperature. Electromagnetic interference can be strong enough to induce sufficient current to actuate the electrical rocket motor ignition system, and also to cause the unlocking of the fuze pre-launch safety lock, a confluence of events which could result in the unintentional launching of an armed missle.

With the passage of time, the electrical components in the rocket motor ignition system will degrade, causing an increase in the mathematical probability of a misfire. Even if successfully fired, degradation of the electrical apparatus for unlocking the fuze pre-launch safety lock could result in its failure to operate and thus result in the launching of a missile with an unarmed warhead, with the compound probability of the two foregoing events serving to decrease the reliability of the missile. The problems of rocket motor misfire and failure of the fuze pre-launch safety lock to unlock upon command could similarly be caused by a low voltage output occasioned by cold temperatures.

SUMMARY

Briefly, the present invention is a launch sequencer which mechanically sequences the events necessary to launch a missile. The launch sequencer is contained in a cylindrical block which is located between and separates the warhead and the rocket motor of a missile. A cylindrical passageway begins at a lateral surface of the cylindrical block and continues radially through the block's longitudinal axis of symmetry. A notched piston having a cylindrical, hollow core slides within the passageway. Prior to the operation of the launch sequencer, one end of the piston projects from the passageway and is engaged with the launch apparatus, thereby preventing movement of the missile relative to the launch apparatus.

An annular notch in the side of the actuator piston is engaged with a crank pin rotatably mounted on an adjacent rotatable rotor. This configuration translates the linear translation of the actuator piston into rotation of the rotor. The warhead fuze pre-launch safety lock is unlocked by rotation of the rotor through a predetermined angle.

The hollow core of the actuator piston communicates with a source of pressurized gas through an opening in the projecting end of the piston. The introduction of pressurized gas into the actuator piston drives the piston further into the passageway. This travel withdraws the projecting end of the actuator piston from its engagement with the launch apparatus, thereby releasing the missile from this constraint, and forces the rotor to rotate through the predetermined angle necessary to unlock the fuze pre-launch safety lock.

The actuator piston contains several ports through its lateral wall. After the actuator piston has been driven a distance into the passageway greater than the distance required to release the missile from the launch apparatus and unlock the fuze pre-launch safety lock, at least one of the ports is in a position which allows the hollow core of the actuator piston to communicate with an adjacent ignition piston chamber. The flow of the pressurized gas into the ignition piston chamber forces the ignition piston contained therein to sharply impact and ignite the ignition primer which, in turn, ignites the rocket motor igniter and, ultimately, the rocket motor.

The present invention thus obtains, in the desired sequential order, the release of the missile from the launch apparatus, the unlocking of the warhead fuze pre-launch safety lock, and the ignition of the rocket motor. The aforementioned sequencing is accomplished mechanically, and thereby entirely avoids the problems and reduced reliability caused by electromagnetic interference, degradation of the electrical components with age, and inadequate voltage output occasioned by low temperatures, all of which plague electrical sequencing devices. In automatically releasing the missile from rigid attachment to the launch apparatus immediately before the missile is launched, the launch sequencer of the present invention renders unnecessary the time consuming manual removal required for one type of conventional attachment device, as well as preventing the dispersal of launch debris and the adverse effect on the aim of the operator attendant to attaching the missile to the launch apparatus with shear pins.

DETAILED DESCRIPTION OF THE DRAWINGS

Figure 1:
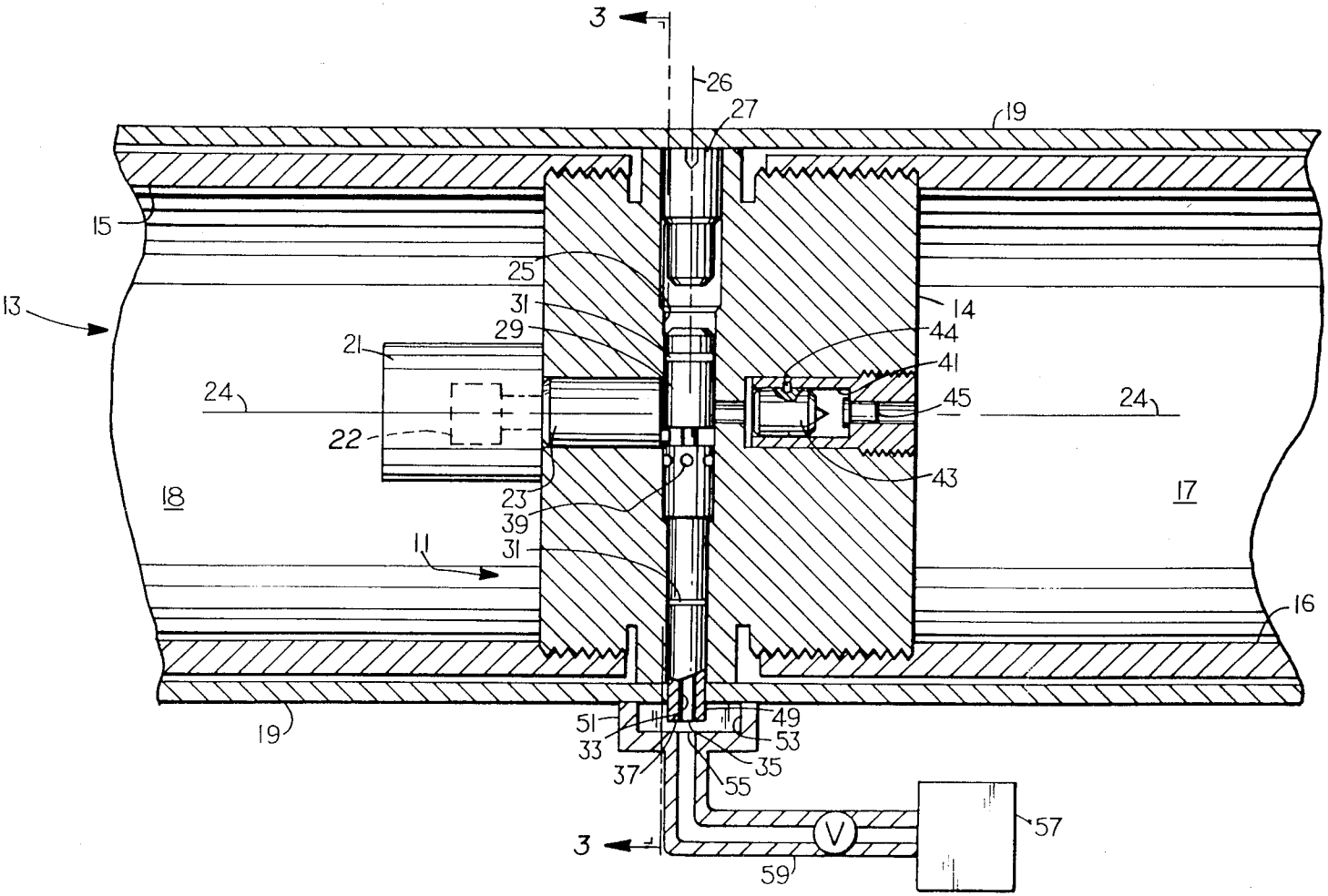
FIG. 1 is a fragmented sectional view of a missile containing a preferred embodiment of the present invention. The embodiment is shown prior to its actuation. (Several elements have not been sectioned in order to provide for improved clarity.)

Reference is now made to the drawings, which illustrate launch sequencer 11, a preferred embodiment of the present invention. More specifically, FIG. 1 shows launch sequencer 11 installed in missile 13. Launch sequencer 11 is contained within cylindrical block 14. Cylindrical block 14 is positioned between and threadably attached to warhead casing 15 and rocket motor casing 16 of missile 13. Rocket motor 17 is contained within rocket motor casing 16. Warhead 18 is contained within warhead casing 15. Rocket motor 17 and warhead 18 are of conventional design. Launch sequencer 11 is intended to function as disclosed herein regardless of the specific configuration of warhead 18 or type of rocket motor 17.

Missile 13 is slidably positioned in launch tube 19. Warhead 18 is connected to warhead fuze 21, and must be armed by warhead fuze 21 before it can detonate. Warhead fuze 21 contains two fuze safety locks, the engagement of either of which prevents warhead 18 from becoming armed. One can only be unlocked by the substantial axial inertial force generated during the launch of missile 13. The second fuze safety lock is pre-launch fuse safety lock 22. Pre-launch fuse safety lock 22 is not influenced by axial force, and must be unlocked prior to launch to enable warhead 18 to become armed. The pre-launch fuze safety lock is mechanically connected to both warhead fuze 21 and rotatable rotor 23, and can be unlocked by rotating rotor 23 through a predetermined angle. Pre-launch fuze safety lock 22 as well as the mechanism operatively connecting it to rotor 23 and warhead fuze 21 are well known to those skilled in the art, and any apparatus serving the functions herein attributed to those apparatus can be similarly used in conjunction with launch sequencer 11.

Axis of symmetry 24 of cylindrical block 14 is colinear with the centerline of missile 13 and also with the axis of revolution of rotor 23. Cylindrical passageway 25 is radially positioned within cylindrical block 14, and has axis of symmetry 26. Piston stop 27 is a solid plug that lies at one extremity of passageway 25. Actuator piston 29 is a cylindrical piston slideably located in passageway 25 in the section unoccupied by piston stop 27. The centerline of actuator piston 29 is colinear with axis of symmetry 26. O-rings 31 circumscribe actuator piston 29 to obtain a gas-tight seal between actuator piston 29 and the walls of passageway 25.

Hollow cylindrical core 33 is contained within actuator piston 29. Orifice 35 is located in piston end 37. Ports 39 are openings in the side of actuator piston 29. All of ports 39 are located at the same axial station of actuator piston 29. Core 33 communicates with orifice 35 and ports 39.

Ignition piston chamber 41 is a cylindrical cavity contained within cylindrical block 14 and communicating with passageway 25. Ignition piston 43 is slideably located within ignition piston chamber 41. Shear pin 44 keeps ignition piston 43 from sliding until it is desired to ignite rocket motor 17. The respective axes of symmetry of ignition piston chamber 41 and ignition piston 43 are colinear with axis of symmetry 24. It should be noted, however, that the aforementioned colinearity with axis of symmetry 24 is not essential for the invention to function as intended, and the axes of symmetry of ignition piston chamber 41 and ignition piston 43, while remaining colinear with each other, may be changed to suit the design requirements of another embodiment of the invention.

Ignition primer 45 is also located within ignition piston chamber 41. The ignition of rocket motor 17 is obtained by a sequence of events beginning with ignition piston 43 striking and igniting ignition primer 45. Ignition primer 45 then ignites the rocket motor igniter (not shown) which, in turn, ignites the propellant in rocket motor 17.

Figure 2:
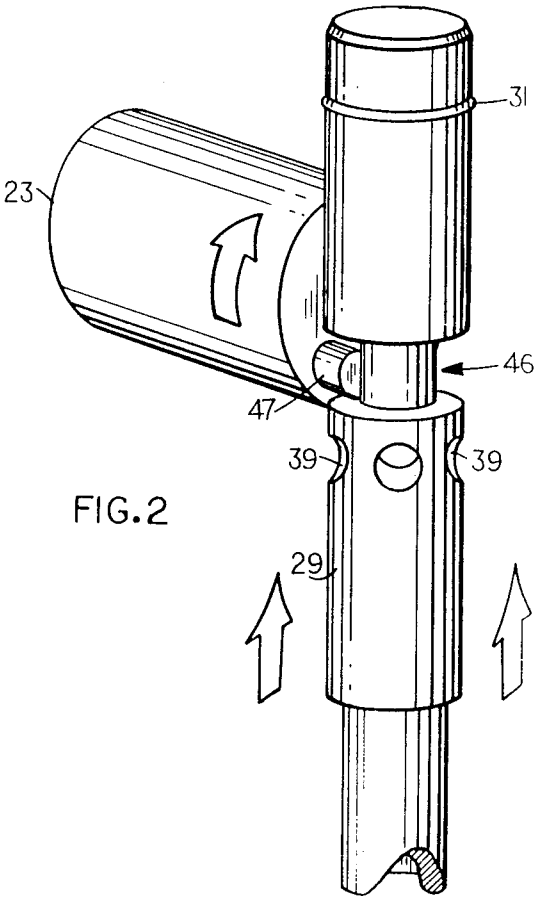
FIG. 2 is an enlarged fragmentary drawing which shows the engagement of the actuator piston with the crank pin of the rotor.

As particularly shown in FIG. 2, annular notch 46 is located in the side of actuator piston 29. Crank pin 47 is cylindrical, and is rotatably mounted on the planar face of rotor 23 that lies adjacent to actuator piston 29. Annular notch 46 is engaged with crank pin 47, with the engagement being sufficiently loose to allow crank pin 47 to move laterally within notch 46.

Prior to the actuation of launch sequencer 11 and the launch of missile 13, actuator piston 29 is only partially enclosed within passageway 25, with projecting piston length 49 left projecting from passageway 25 and through a circular opening in launch tube 19. The projection of projecting piston length 49 through the circular opening in launch tube 19 rigidly positions missile 13 in launchtube 19. Dome 51 is attached to launch tube 19 opposite passageway 25, and is adapted to enclose projecting piston length 49. Cavity 53 is located within dome 51 and communicates with core 33 through orifice 35. Orifice 55 is a passageway through the top of dome 51. Source of pressurized gas 57 communicates with cavity 53 through hose 59 and orifice 55. Thus, source of pressurized gas 57 communicates with core 33.

Figure 3:
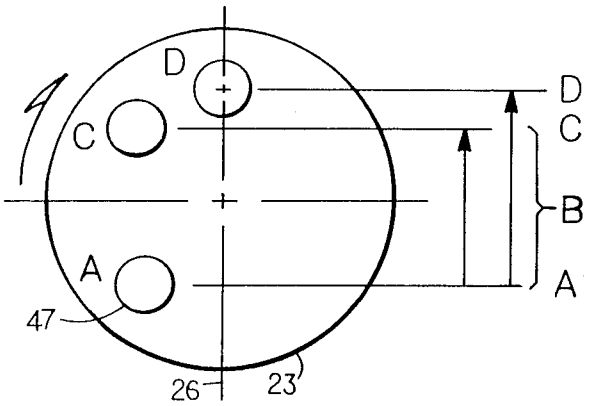
FIG. 3 includes a sectional view taken along line 3—3 of FIG. 1. This view illustrates the end of the rotor and the attached crank pin in several successive positions. Adjacent to the sectional view is a diagram which shows the corresponding travel of the actuator piston.

FIG. 3 includes a sectional view taken along line 3—3 of FIG. 1, and shows the end of rotor 23 and crank pin 47 in several rotated positions. Located to the right of the sectional view is a diagram which illustrates the linear travel of actuator piston 29 corresponding to each of the positions of rotor 23 and crank pin 47. The starting, pre-launch position of rotor 23 and crank pin 47 is designated as Position A. Upon the flow of pressurized gas from source of pressurized gas 57 into core 33, actuator piston 29 moves into passageway 25 for a distance sufficient to draw projecting length 49 into passageway 25, and thereby release missile 13 from constraint. The travel necessary for actuator piston 29 to release missile 13 is thus equal to projecting piston length 49, and is noted as Position B. Although actuator piston 29 is slideably positioned in passageway 25, the fit between O-rings 31 and passageway 25 is tight enough to prevent the movement of actuator piston 29 due to the force of gravity alone, and the force generated by the introduction of pressurized gas into core 33 is required to drive actuator piston 29 into passageway 25.

Figure 4:
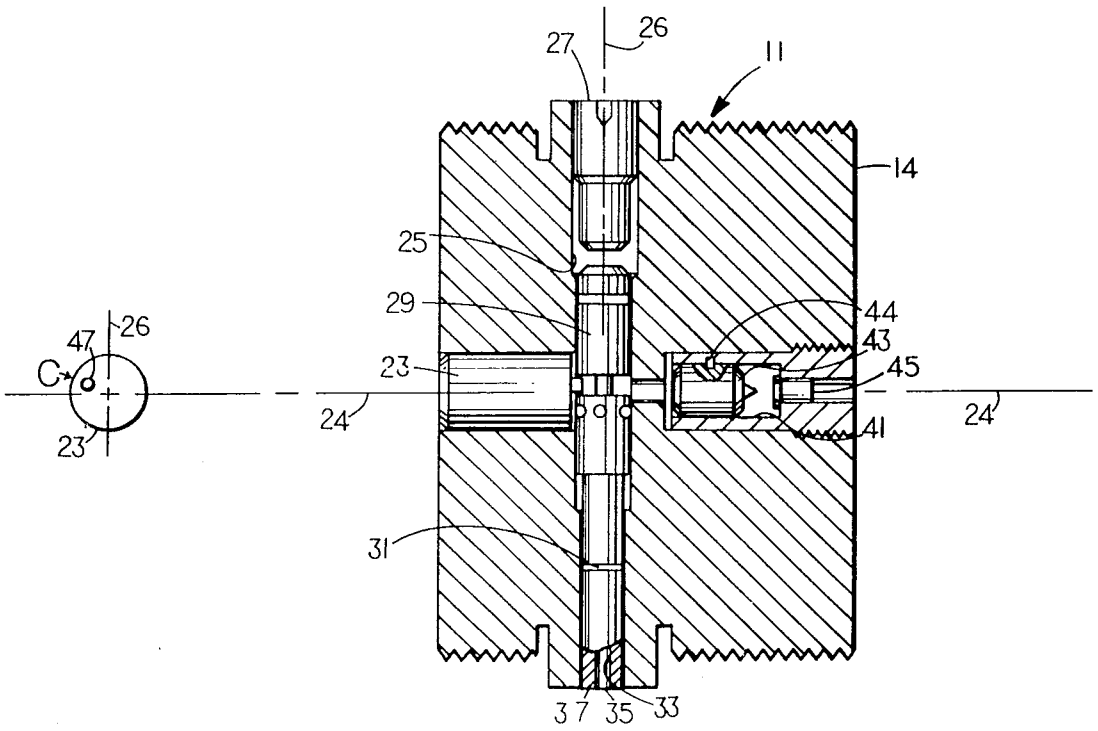
FIG. 4 illustrates the same sectional view of the preferred embodiment of the present invention previously shown in FIG. 1, but with the actuator piston having moved to a position which has released the missile from the launch apparatus and has also unlocked the fuse pre-launch safety lock. An end view of the rotor is also provided which shows the corresponding position of the crank pin and rotor (Position C).

As shown in FIG. 4, pre-launch fuze safety lock 22 is unlocked when notch 46 forces crank pin 47 to rotate rotor 23 into Position C. The unlocking occurs at the same time or after the release of missile 13, and thus the travel of actuator piston 29 represented by Position B is shown in FIG. 3 as having a variable value equal to or less than the corresponding travel of actuator piston 29 necessary to arrive at Position C.

Figure 5:
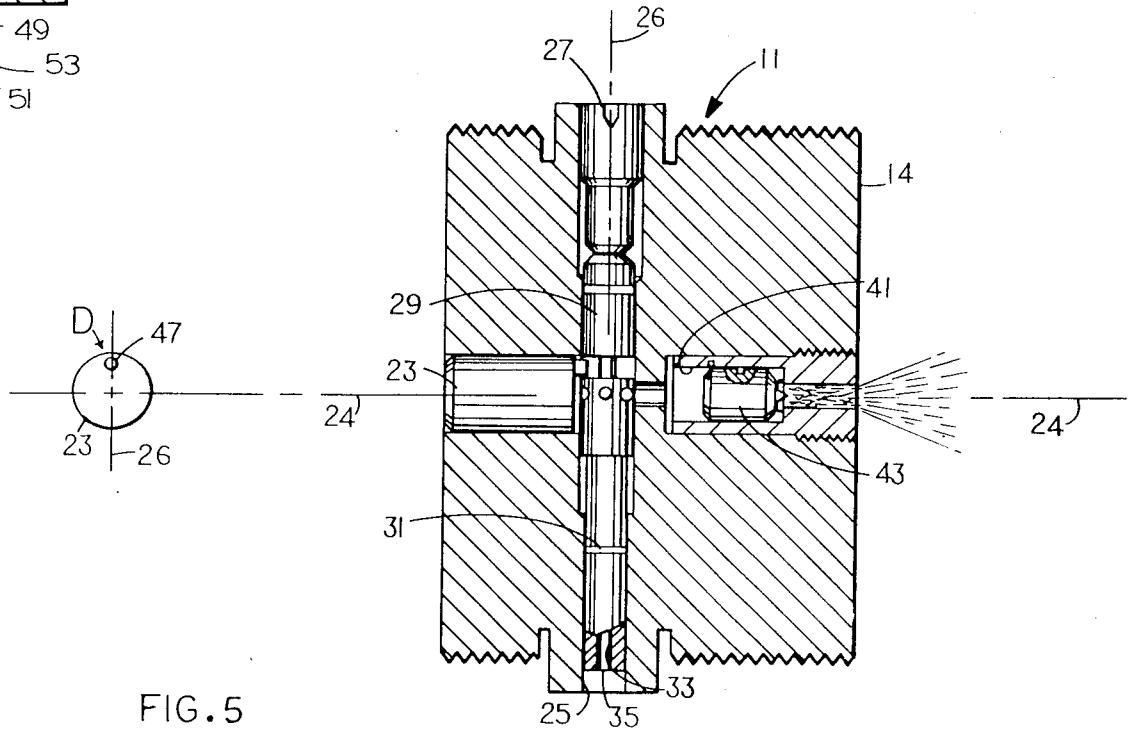
FIG. 5 illustrates the same sectional view of the preferred embodiment of the present invention previously shown in FIGS. 1 and 4, but with the actuator piston having continued its travel into the passageway until its ports are uncovered to allow the pressurized gas to flow into the ignition piston chamber. An end view of the rotor is also provided which shows the corresponding position of the crank pin and rotor (Position D).

As shown in FIG. 5, further travel of actuator piston 29 into passageway 25 uncovers at least one port 39 and allows core 33 to communicate with ignition piston chamber 41. This communication allows pressurized gas to flow into ignition piston chamber 41, whereupon force is generated against ignition piston 43 having a magnitude sufficient to shear shear pin 44. Ignition piston 43 subsequently is forced to slide and sharply impact ignition primer 45, igniting ignition primer 45 and, in turn, the rocket motor igniter and rocket motor 17. The rotational position of crank pin 47 and rotor 23 necessary to ignite rocket motor 17 and launch missile 13 is noted as position D. The correlative travel of actuator piston 29 is greater than the travel required to release missile 13 or unlock pre-launch fuze safety lock 22, as graphically illustrated in FIG. 3. As practiced in the preferred embodiment of the present invention, the travel of actuator piston 29 will unlock pre-launch fuze safety lock 22 approximately one millisecond before obtaining the ignition of ignition primer 45.

The actuation of launch sequencer 11 thus provides, in sequenced order: the release of missile 13 from launch tube 19 (position B); the unlocking of pre-launch fuze safety lock 22 (position C); and the ignition of rocket motor 17 (position D). The sequencing of events obtained by launch sequencer 11 ensures the release of missile 13 from launch tube 19 and the unlocking of the pre-launch fuze safety lock 22 prior to the ignition of rocket motor 17 and the launch of missile 13. In the event of an accidental ignition of rocket motor 17 by a foreign means, launch sequencer 11 will prevent the release of missile 13 from launch tube 19 and/or prevent warhead 18 from becoming armed.

Although the preferred embodiment of the present invention was hereinbefore described as being used in a missile launched from a launch tube, it could similarly be employed to sequence the launch events of a missile positioned and launched from any suitable apparatus, for example, a rail.

Figure 6:
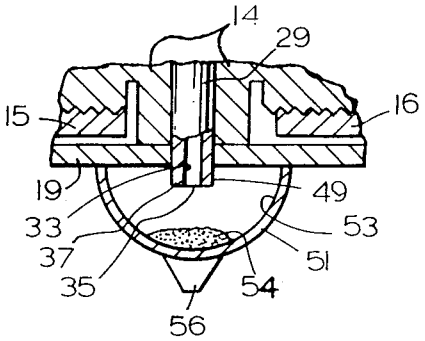
FIG. 6 is a sectioned breakaway drawing which shows a second preferred embodiment wherein the pressurized gas used to propel the actuator piston is generated from the ignition of combustible material by a percussive apparatus.

In another preferred embodiment of the present invention, the pressurized gas used to propel actuator piston 29 into passageway 25 could be generated by the ignition of a combustible material located in cavity 53. In such a variation, source of pressurized gas 57 and hose 59 would not be employed, and dome 51 would not include orifice 55. Rather, as shown in FIG. 6, dome 51 would be configured to provide for the ignition of combustible material 54 contained therein by percussive apparatus 56. The elements and operation of this preferred embodiment would otherwise be the same as hereinbefore described with respect to launch sequencer 11.

Changes and modifications in the specifically described embodiments can be carried out without departing from the scope of the invention, which is intended to be limited only by the scope of the appended claims.

What we claim is:

1. Apparatus for sequencing events necessary to arm and launch a missile comprising:

a missile launcher;

a missile including a warhead fuze and a rocket motor;

a block located in said missile;

a passageway situated in said block;

an actuator piston slidably positioned in said passageway;

said actuator piston and said missile launcher being engaged;

said actuator piston having a hollow core, a port communicating with said hollow core, a closed end and an open end;

gas means for introducing a gas into said hollow core through said open end so that said actuator piston travels in said passageway;

a fuze safety lock preventing the arming of said warhead fuze when locked;

said block containing means for igniting said rocket motor;

said travel of said actuator piston in said passageway disengages said missile from said missile launcher, unlocks said fuze safety lock, and permits said gas to communicate with said ignition means through said port and thereby actuate said ignition means.

2. The launch sequencer defined in claim 1 wherein:

said fuze safety lock is connected to a rotatable rotor, and is unlocked by the rotation of said rotatable rotor through an angle;

said actuator piston is engaged with said rotatable rotor; and the rotation of said rotatable rotor through said angle is obtained from work performed by said actuator piston during said travel.

3. The launch sequencer defined in claim 2 further comprising:

means for obtaining a gas-tight fit between said actuator piston and said passageway.

4. The launch sequencer defined in claim 3 wherein:

said block is cylindrical with its axis of symmetry coinciding with the longitudinal axis of said missile; and said passageway is radial with respect to said axis of symmetry of said block.

5. The launch sequencer defined in claim 4 further comprising:

a warhead; wherein said missile includes said warhead; and said block is located axially between said warhead and said rocket motor, and attaches said warhead to said rocket motor.

6. The launch sequencer defined in claim 4 further comprising:

a crank pin rotatably attached to said rotatable rotor at a point lying apart from the axis of rotation of said rotatable rotor; and said actuator piston having a notch shaped to engage said crank pin; whereby said travel of said actuator piston forces said crank pin to rotate about the axis of rotation of said rotatable rotor and thereby rotates said rotatable rotor through said angle.

7. The launch sequencer defined in claim 6 wherein:

said missile launcher is comprised of a rail, at least one mounting slidably attached to said rail, and means for removably attaching said missile to said at least one mounting; and said rail has a recess which accepts said actuator piston.

8. The launch sequencer defined in claim 7 wherein:

said gas means is comprised of a source of pressurized gas communicating with said recess.

9. The launch sequencer defined in claim 7 wherein:

said gas means is comprised of a combustible material which generates gas when ignited and is located in said recess, and percussive means for igniting said combustible material.

10. The launch sequencer defined in claim 6 wherein:

said missile launcher is comprised of a hollow tube having at least one open end;

said hollow tube allowing for the slidable movement therein of said missile; and said hollow tube having an opening in its side which allows for the passage therethrough of said actuator piston.

11. The launch sequencer defined in claim 10 further comprising:

a dome attached to a side of said hollow tube;

said dome being located opposite said opening; and said dome enclosing a projecting length of said actuator piston.

12. The launch sequencer defined in claim 11 wherein:

said gas means is comprised of a source of pressurized gas communicating with said dome.

13. The launch sequencer defined in claim 11 wherein:

said gas means is comprised of a combustible material which generates gas when ignited and is located in said dome, together with percussive means for igniting said combustible material.

14. Apparatus for mechanically sequencing events necessary to arm and launch a missile which includes a warhead fuze and a rocket motor comprising:

a block located in said missile;

a passageway situated in said block;

an actuator piston slidably positioned in said passageway;

means for introducing pressurized gas into said passageway so that said actuator piston is forced to travel in said passageway;

a fuze safety lock for preventing the arming of said warhead fuze when locked, and being unlocked by said travel of said actuator piston; and mechanical means communicating with said pressurized gas for igniting said rocket motor, said mechanical ignition means being contained in said block and being actuated by said travel of said actuator piston.

15. The launch sequencer defined in claim 14 further comprising:

a missile launcher engaged with said actuator piston; and said travel of said actuator piston disengaging said actuator piston from said missile launcher; whereby said travel of said actuator piston disengages said missile from said missile launcher.

* * * * *

UNITED STATES PATENT AND TRADEMARK OFFICE

CERTIFICATE OF CORRECTION

PATENT NO. : 4,716,808

DATED : January 5, 1988

INVENTOR(S) : Robert L. Hoch, et al.

It is certified that error appears in the above-identified patent and that said Letters Patent is hereby corrected as shown below:

In column 1, line 54, the word "temperature" should be -- temperatures --.

In column 3, line 67, delete the word "The" and insert -- 22 -- after the word "lock".

In column 4, line 63, the word "launchtube" should be -- launch tube --.

In column 5, line 60, delete the word "the" after the word "of".

Signed and Sealed this

Fifth Day of September, 1989

*Attest:*

*Attesting Officer*

DONALD J. QUIGG

*Commissioner of Patents and Trademarks*